US009723880B1

(12) United States Patent
Macey, Jr.

(10) Patent No.: US 9,723,880 B1
(45) Date of Patent: Aug. 8, 2017

(54) COUGH CATCHER

(76) Inventor: John W. Macey, Jr., Nashville, TN (US)

( * ) Notice: Subject to any disclaimer, the term of this patent is extended or adjusted under 35 U.S.C. 154(b) by 788 days.

(21) Appl. No.: 12/135,118

(22) Filed: Jun. 6, 2008

Related U.S. Application Data

(60) Provisional application No. 60/933,406, filed on Jun. 6, 2007.

(51) Int. Cl.
*A61B 19/00* (2006.01)
*A41D 13/11* (2006.01)

(52) U.S. Cl.
CPC ..... *A41D 13/11* (2013.01)

(58) Field of Classification Search
USPC ..... 128/201.25, 206.12, 206.19, 863
See application file for complete search history.

(56) References Cited

U.S. PATENT DOCUMENTS 2,655,150 A * 10/1953 Cupp ..... 128/206.19
3,719,188 A 3/1973 Fisher et al. ..... 128/275
4,361,146 A * 11/1982 Woicke ..... 128/206.12
5,322,061 A * 6/1994 Brunson ..... 128/206.13
5,772,644 A * 6/1998 Bark et al. ..... 604/317
6,986,348 B2 1/2006 Carter ..... 128/201.3
7,013,494 B2 3/2006 Wilkins ..... 2/279
2006/0005838 A1* 1/2006 Magidson ..... 128/206.19
2006/0201513 A1* 9/2006 Chu ..... 128/206.19

FOREIGN PATENT DOCUMENTS

WO 2009070868 A1 6/2009

OTHER PUBLICATIONS

U.S. Appl. No. 60/933,406, filed Jun. 6, 2007, by Macey.

* cited by examiner

*Primary Examiner* — Victoria J Hicks
(74) *Attorney, Agent, or Firm* — Lucian Wayne Beavers; Patterson Intellectual Property Law, PC

(57) ABSTRACT

The apparatus prevents the spread of airborne diseases. An outer sleeve has a passage with a filter element. A user grabs the outer sleeve and coughs or sneezes into the passage. The filter element traps airborne pathogens within the outer sleeve. The outer sleeve thus allows a user to handle the device without being contaminated by the aerosolized emissions emitted during coughing or sneezing within the passage.

20 Claims, 4 Drawing Sheets

COUGH CATCHER

CROSS-REFERENCES TO RELATED APPLICATIONS

This application is a Non-Provisional Utility application which claims benefit of provisional U.S. Patent Application Ser. No. 60/933,406 filed Jun. 6, 2007, entitled "ARTICLE OF MANUFACTURE FOR TRAPPING AND ISOLATING PATHOGENS FOUND IN COUGH EMISSIONS" which is hereby incorporated by reference.

BACKGROUND OF THE INVENTION

This invention relates generally to a device that prevents the spread of airborne diseases. More specifically, the invention relates to a portable device that traps pathogens found in cough/sneeze emissions which can be applied when a cough or sneeze is imminent.

Upper respiratory infections are a significant source of morbidity and indeed mortality throughout the world. Many viral and bacterial infections are transmitted through aerosolized droplets, which are emitted when an individual coughs or sneezes. Tuberculosis and influenza are perhaps the most notorious diseases transmitted in this way. The threat of airborne diseases has been exacerbated by the emergence of multiple-drug-resistant tuberculosis, threats related to bird-flu, and incurable respiratory infections known as SARS. While current widespread therapies are directed at alleviating the cough, and treating the causative organism, initiatives directed toward controlling the spread of such airborne diseases have been consistently ineffective.

The CDC (Center for Disease Control), the DDHS (Department and Human Services, USA), and the APIC (Association for Professionals in Infection Control and Epidemiology) currently make the following recommendations to limit the spread of airborne diseases:

1. Cover your mouth and nose with a tissue when you cough or sneeze.
2. If you don't have a tissue, cough or sneeze into your upper sleeve, not your hands.
3. Put your used tissue in the waste basket.
4. Clean your hands after coughing or sneezing.
5. Wash with soap and water.
6. After sneezing or coughing, clean yourself with an alcohol-based hand cleaner.
7. You may be asked to put on a surgical mask to protect others.

These recommendations however are impractical for several reasons. First, these instructions require an infected person to always be close to a waste repository to dispose of the infected tissue and a sink to clean one's hands after coughing or sneezing. Second, coughing and sneezing are usually not isolated incidents but are continually repeated by the infected person. Washing one's hands is impractical after every cough or sneeze and may cause skin irritation. If these facilities are not continually available to the infected person and the person has to cough into their sleeve, the sleeve soon becomes a culprit in the spread of the disease until the shirt is washed.

Tissue is also not an adequate solution for covering the infected person's mouth and nose because tissue does not effectively protect the hand from contamination. These and other devices are not effective in preventing the spread of airborne diseases because they require the infected person's hand to come into contact with the contaminated "filter element". This spreads the disease through contact with the infected person's hands.

Other more extreme solutions have been created in communities with particularly dangerous diseases. For example, in some countries and communities with an increased incidence of SARS, masks have been distributed to the general population. These masks are distributed to infected and uninfected persons alike to help stop the spread of the disease. Unfortunately, because of the social stigma surrounding people wearing masks and the feeling of confinement masks induce, the general population avoids and often does not wear these masks. Even the CDC is reluctant to take the step of recommending the use of masks.

Consequently, there has been a need to develop devices that can be applied only when a cough or sneeze is imminent. Three examples of these apparatuses are shown in U.S. Pat. No. 3,719,188 ("the 188 Patent"), U.S. Pat. No. 6,986,348 ("the '348 Patent"), and U.S. Pat. No. 7,013,494 ("the '494 Patent").

The '188 Patent discloses a perforated container lined with a filter material that is attached to a mouth piece/nasal chute with a mouth piece cover. The walls of the perforated container have perforation to provide airflow through the container. The mouth piece is grasped in the user's mouth prior to a cough. The perforated container is shaped like a cigarette pack and is fixed in this configuration. Unfortunately, the device described in the '188 Patent leaves the filter element to some degree in contact with the user's hand, through the multiple side and bottom perforations. The expulsion of cough emissions will be into the hand holding the device, and although filtered, some hand contamination with seeping moisture through the holes is inevitable. Another deficiency is in the mouthpiece configuration. One must apply one's lips over the mouthpiece and create a seal with the lips prior to cough. This is cumbersome, especially when some degree of involuntary lip contracture occurs with cough.

Next, the '348 patent describes a T-shaped system of tubes and filters and one-way valves and screens. This hard plastic device also has a fixed configuration and is designed both for filtering microorganisms and for reducing the noise associated with the cough. The device is worn by the user. However, the device is cumbersome and is not designed for easy storage and transport.

Finally, the '494 patent describes a handkerchief pocket for holding a handkerchief so that the user does not have to handle the handkerchief during coughing. Pathogens may still be spread however because the device does not isolate the user from the handkerchief.

What is needed then is an apparatus for filtering pathogens expelled during coughing or sneezing that isolates the user from respiratory system emissions but that does not have to be worn as a mask.

BRIEF SUMMARY OF THE INVENTION

The invention is a device that prevents the spread of airborne diseases by trapping airborne viral, bacterial, and mycobacterium pathogens while isolating the filter element from the user. In one embodiment, the apparatus has a collapsible outer sleeve that defines a passage having a passage opening. A collapsible filter element is attached within the passage of the collapsible outer sleeve so that collapsing the outer sleeve also collapses the filter element. During coughing or sneezing, the user handles the outer sleeve and places a passage opening around the user's mouth and/or nose. The outer sleeve isolates the user from the filter element since the panels of the outer sleeve provide a barrier between the aerosolized droplets and the user.

Since the filter element is attached within the passage, the infected person's hands are not contaminated by repetitive coughing or sneezing. The contaminated filter element traps aerosolized droplets containing pathogens, such as viruses and bacteria within the filter element.

To prevent the social stigma associated with wearing a mask, the outer sleeve collapses thereby allowing for easy and portable storage of the device. In one embodiment, the outer sleeve collapses into a flattened position thereby making it easy for the user to carry the device. The device may be sized and configured for placement into a shirt or hip pocket. The filter element may also be collapsible so that collapsing the outer sleeve also collapses the filter element within the sleeve. This device thus provides a discreet solution for the patient with a cough or sneeze.

Utilizing this device, the infected individual has the ability to be effectively proactive while not having to endure the social stigma associated with the use of a mask. The infected person may conveniently carry the device with them and continue work or school without having to risk spreading their infection.

The primary object of the invention is to provide a device that prevents the spread of airborne diseases.

Another object of the invention is to trap airborne pathogens found in the emissions of a cough or a sneeze.

Another object of the invention is to isolate airborne pathogens from a user's hands and clothing.

Another object of the invention is to provide a cost-effective solution for preventing the spread of airborne diseases.

Another object of the invention is to provide a practical device for preventing the spread of airborne diseases.

A further object of the invention is to provide a portable device for preventing the spread of airborne diseases.

Yet another object of the invention is to provide a disease prevention device that can be utilized multiple times.

Other objects and advantages will become apparent from the following descriptions, taken in connection with the accompanying drawings, wherein, by way of illustration and example, an embodiment of the present invention is disclosed.

DETAILED DESCRIPTION OF THE INVENTION

Figure 1:
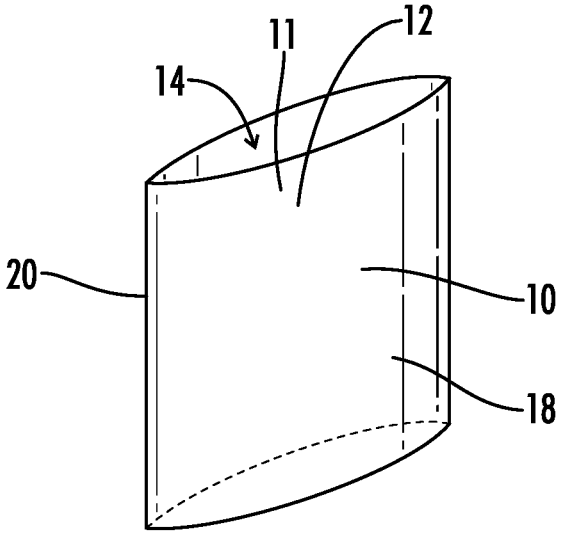
FIG. 1 is a perspective view of one embodiment of the collapsible outer sleeve for the device of this invention.
Figure 2:
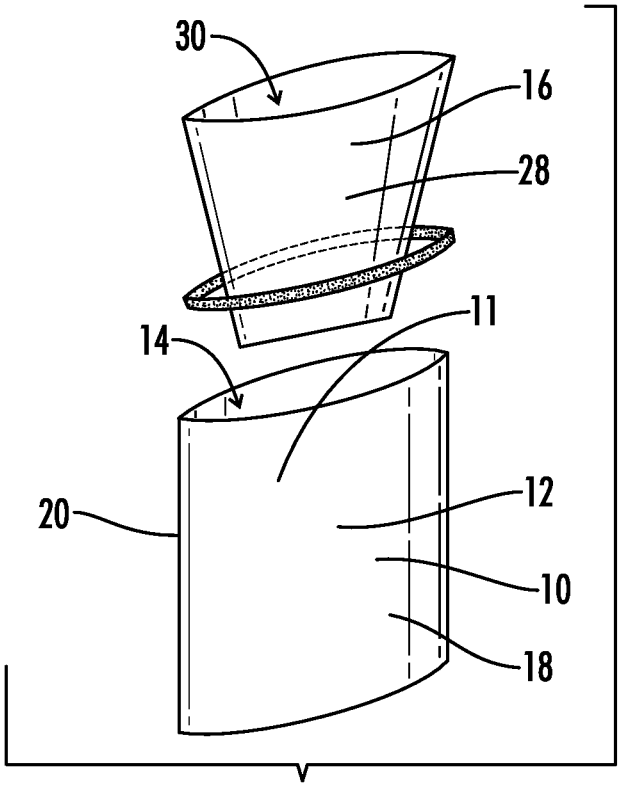
FIG. 2 is an exploded view of one embodiment of the device of this invention.

Referring now to FIG. 1 and FIG. 2, one embodiment of the disease prevention device is shown. In FIG. 1, a collapsible outer sleeve 10 has an interior 11 that defines a passage 12 with a passage opening 14. This collapsible outer sleeve 10 is utilized to isolate the cough or sneeze of the infected person. A user will place the passage opening 14 around the user's mouth and/or nose during coughing or sneezing and cough or sneeze into the passage 12. The collapsible outer sleeve 10 provides a shell that may be constructed from an impermeable material, such as the surgical plastic utilized in surgical masks, to assure that the aerosolized droplets and pathogens in those droplets of the cough or sneeze are contained within the passage 12 of the collapsible outer sleeve 10. The outer sleeve 10 may also be made of other materials functional to contain the contaminated droplets within the passage 12. Materials of the outer sleeve 10 may also be printable or of various colors to provide decorative appeal, to hide the cough/sneeze emissions emitted into the sleeve, and to identify different sizes/versions of the device.

In other words, the apparatus includes an outer flattened expandable tubular shell 10 for holding, providing a reservoir in which to cough, with an open entry end 26 and an open exit end 27 for cough direction. The outer shell 10, which is essentially a flattened tube, acting as an expandable sleeve, made of intermediate durability, impermeable, flexible material is shown configured of flexible plastic but could be configured of other materials.

Figure 3:
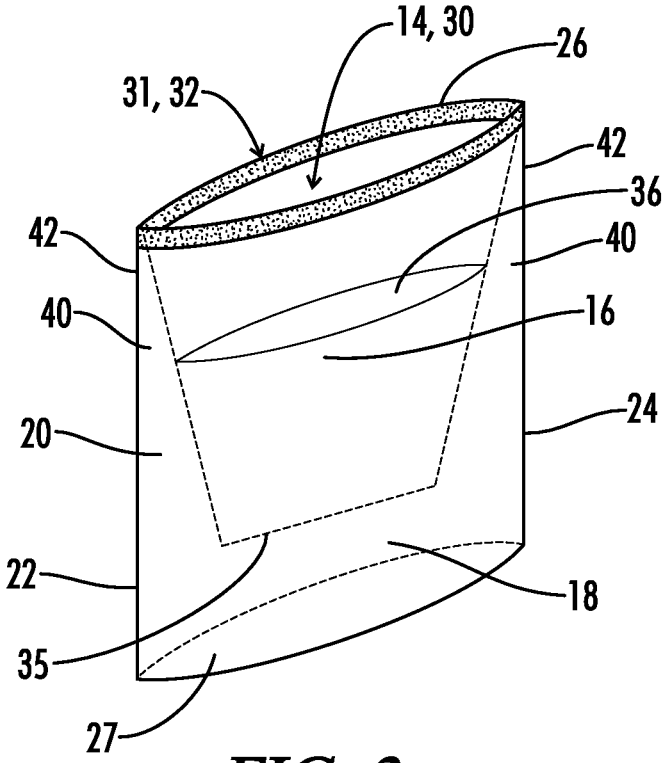
FIG. 3 is a perspective view of the embodiment shown in FIG. 2 when the device is assembled.
Figure 6:
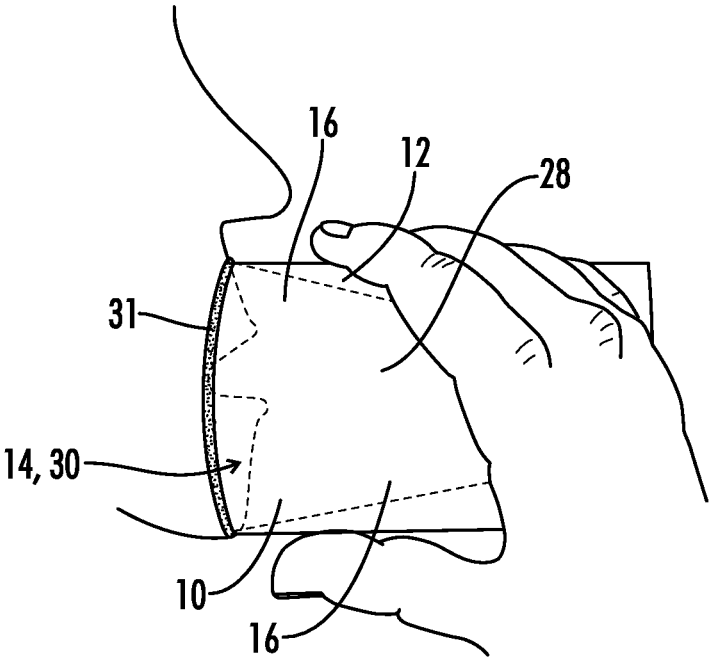
FIG. 6 shows a side view of the embodiment of the device illustrated in FIG. 1 applied around the mouth of a user during coughing.

Referring now to FIGS. 2, 3 and 6, a collapsible filter element 16 is attached within the passage 12 of the collapsible outer sleeve 10 so that collapsing the outer sleeve 10 also collapses the filter element 16. The filter element 16 of the illustrated embodiment defines a recess 28 and a recess opening 30 for receiving contaminated aerosolized droplets. The filter element 16 may be attached to the passage 12 with a sealing element 31 so that the recess opening 30 is attached at the passage opening 14. The filtering element 16 may also be fused with the passage to provide a sealed connection. Providing a sealed connection helps ensure that all of the aerosolized droplets of the cough/sneeze are filtered though the filter element 16.

The recess 28 may extend into the passage 12 of the collapsible outer sleeve 10. Attaching the filter element 16 at the passage opening 14 ensures that the aerosolized droplets from the sneeze or cough are immediately filtered through the filter element 16. By shaping the filter element 16 to have a recess 28, the user may place the device directly over their mouth and/or nose, as shown in FIG. 6, and not contact the contaminated filter element 16 even if the filter element is attached at the passage opening 14 of the outer sleeve 12.

This filter element 16 may be made of a material for trapping the aerosolized emissions of the cough to filter pathogens, such as viruses or bacteria. For example, the filter may be made out of the same filtering material found in surgical masks. Materials for filtering out pathogens, such as viruses and bacteria, from the respiratory system emissions are well known in the art.

Figure 4:
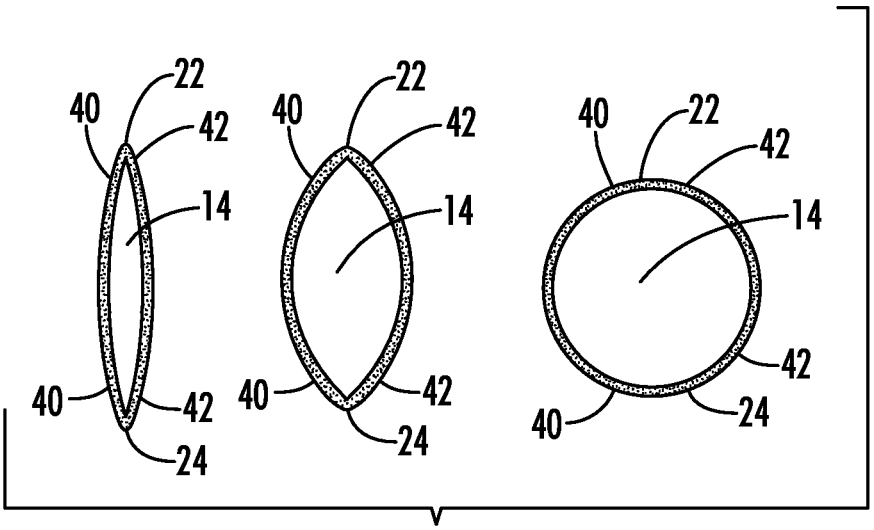
FIG. 4 is an end view of the collapsible outer sleeve shown in FIG. 1 transitioning from a collapsed position for storage to an open position for engagement with a user's face.
Figure 5:
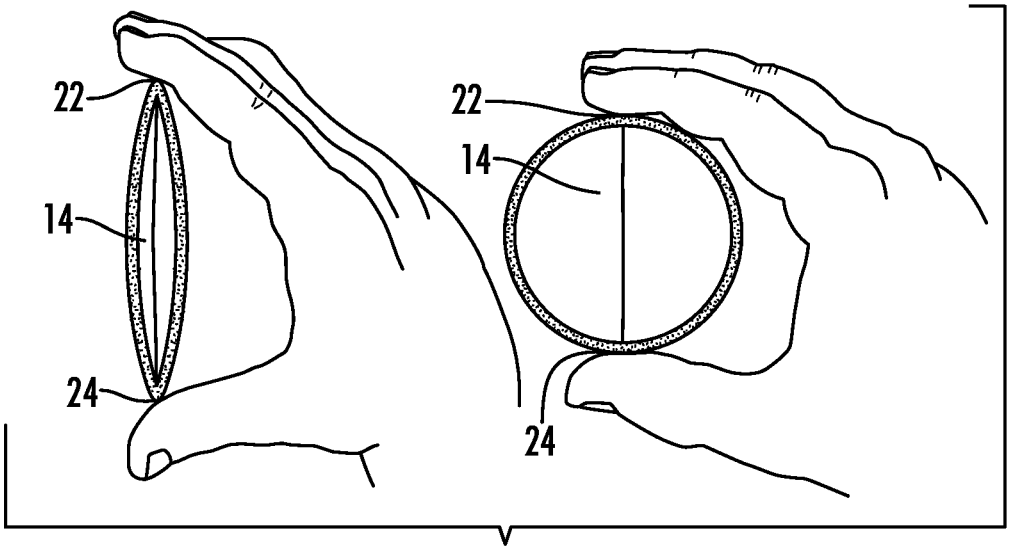
FIG. 5 is an end view of the collapsible outer sleeve illustrated in FIG. 1 as a user's hand applies pressure to the sleeve to transition the collapsible outer sleeve from a collapsed position to an open position.

Referring now to FIG. 3-5, the device may be placed in a collapsed position that allows for easy storage. In the collapsed position, the volume of the passage 12 is reduced for storage and the collapsible filter element 16 collapses by conforming to this reduction in the volume of the passage 12. In the illustrated embodiment, the collapsible outer sleeve 10 and the filter element 16 of the illustrated embodiment are flattened in the collapsed position. The outer sleeve 10 may be flattened to the point that the passage 12 has no volume so that the passage 12 is completely closed.

Placing the device in the collapsed position permits a user to conveniently store the device. For example, if the device is sized appropriately, the user may store the flattened device in a shirt or hip pocket. Consequently, it is contemplated that the device may be sized to fit within standard pocket sizes in the collapsed position. The dimensions of these pockets are well known in the art and thus the manufacturing of the device may be adapted to conform to the sizing requirements for fitting an object into a pocket. Indicia may be placed on the collapsible outer sleeve 10 to identify the size of the device or the appropriate portable storage apparatus for transporting the device (for example, "pocket sized"). In this manner, a user can transport the device with them and continue with daily activities.

From the collapsed position, the collapsible outer sleeve 10 is expandable into an open position. In the open position, the collapsible outer sleeve 10 and the filter element 16 expand so that a user's face can engage the passage opening 14 during coughing/sneezing. The illustrated embodiment shows that the outer sleeve 10 may have a tubular shape in the open position and the passage opening 14 of the passage 12 may be on an end 26 of the sleeve 10. The user then places the open end 26 of the device against their face during coughing or sneezing. The opposite end 27 of the passage 12 may also be open and/or have perforations to provide airflow through the device. The perforations should be placed so that the exiting airflow is unlikely to make contact with a user's hands. For example, the perforations may be at the opposite end 27 so that the airflow does not contact a user grabbing the device near open end 26.

To allow for the collapse and expansion of the device, the device may have oppositely disposed first and second panels, 18, 20. As shown in FIG. 1, the panels 18, 20 may be rectangular. Side edges 40, 42 of the panels 18, 20 are connected at first and second panel junctions 22, 24. These panel junctions 22, 24 may be a crease or bend that provides a movable connection. The movable connection between the panels 18, 20 may also be formed by adhering the side edges 40, 42 to one another with an adhesive or adhesive material, such as tape. Also, one panel junction 22, 24 may be formed by a crease or bend while the other panel junction 24, 22 is formed with an adhesive or adhesive material.

The device may be expanded by placing pressure on these panel junctions 22, 24 thereby forcing the panels 18, 20 to bow away from one another. This action may also be described as squeezing the opposed panel junctions toward each other. This causes the outer sleeve 10 to expand from a flattened position to a more tubular configuration, as shown in FIGS. 4 and 5. As the passage 12 is opened, the filter element 16 may open by virtue of the attachment of the recess opening 30 to the passage opening 14. Filter element 16 has a closed end 35 opposite the recess opening 30 shaped so that a cross-sectional area 36 of the recess 28 decreases from the recess opening 30 to the closed end 35.

Referring now to FIG. 6, before coughing/sneezing occurs, the opened collapsible outer sleeve 10 is placed with the sealing element 31 onto the face surrounding the mouth and/or nose and onto the anterior or inferior chin, depending on preference and size of the user. Thus the outer shell 10 acts both as handle with which to manipulate the filter element 16, and as a protective, impermeable layer to isolate the contaminated filter element 16 from the hands and the environment.

Figure 7:
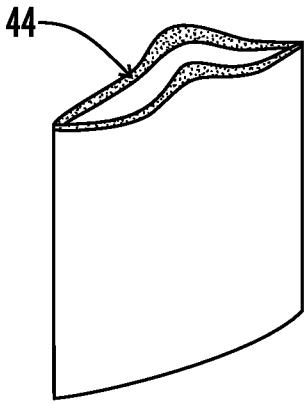
FIG. 7 illustrates an embodiment of the collapsible outer sleeve with a face piece around a passage opening of the sleeve.

In some embodiments there may be an additional face piece 44 that acts as a contact edge as seen in FIG. 7. Face piece 44 should be shaped to comfortably engage a user's face when the passage opening 14 is placed around the mouth and/or nose. The outer sleeve 10 may be of variable sizes so that the passage opening 14 is configured to fit around various sizes and shapes of faces and mouths. Passage opening 14 of the outer sleeve 10 may have a face contact configuration of adequate dimension and appropriate shape to cove the nose as well as the mouth.

Figure 8:
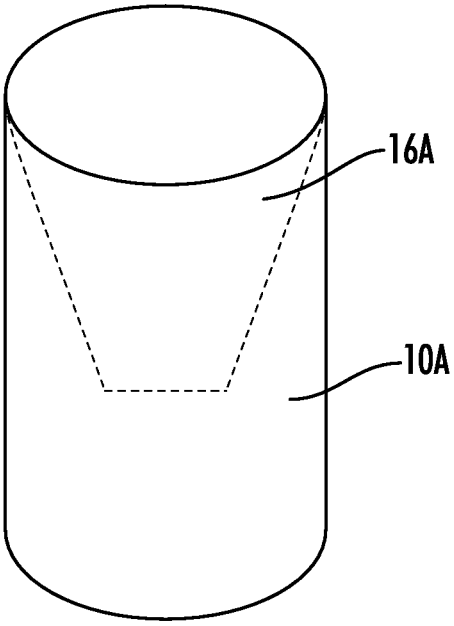
FIG. 8 shows another embodiment of the device.

In another configuration, illustrated in FIG. 8, the outer sleeve 10A may be fixed in an open tubular configuration rather than being collapsible. This embodiment provides for easier handling for the less adept user, although the embodiment is less compact for storage. In this embodiment, the filtering element 16A in the sleeve 10A does not need to be collapsible.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Thus, although there have been described particular embodiments of the present invention of a new and useful COUGH CATCHER, it is not intended that such references be construed as limitations upon the scope of this invention except as set forth in the following claims.

The invention claimed is:

1. An apparatus for preventing the spread of airborne disease expelled when a user coughs or sneezes, comprising:

a collapsible outer sleeve defining a passage having a passage opening, the outer sleeve being constructed from an impermeable material impermeable to both airflow and aerosolized droplets, the passage having first and second open ends when the sleeve is in an expanded position, and the outer sleeve being able to be flattened to define a collapsed position, the collapsible outer sleeve including oppositely disposed first and second panels, the panels being movably attached at first and second opposed panel junctions to allow movement of the panels between the collapsed position and the expanded position when the opposed panel junctions are squeezed toward each other, the outer sleeve being configured to be hand held so that the apparatus does not have to be worn as a mask; and a collapsible filter element attached within the passage of the collapsible outer sleeve so that flattening the outer sleeve also collapses the filter element.

2. The apparatus of claim 1, wherein:

the passage opening is defined at the first open end of the sleeve; and the filter element being sealed to the passage opening.

3. The apparatus of claim 1, wherein the filter element defines a recess, the recess having a recess opening sealed to the passage opening so that the recess extends into the passage of the outer sleeve.

4. The apparatus of claim 1 wherein the filter element is made of a material that traps aerosolized droplets.

5. An apparatus for preventing the spread of airborne diseases, comprising:

an expandable sleeve including oppositely disposed first and second rectangular panels made from a flexible material, the sleeve having an interior that defines a tubular passage having two open ends when the sleeve is expanded, the sleeve being collapsible to a collapsed position wherein the passage is substantially completely closed;

an expandable filtering device attached to the interior of the expandable sleeve and extending across the passage so that expanding the sleeve also expands the filtering device; and wherein the sleeve comprises an impermeable material impermeable to airflow and aerosolized droplets from a human cough or sneeze.

6. The apparatus of claim 5, wherein:

the filtering device is sealed to the sleeve adjacent one of the open ends of the passage.

7. The apparatus of claim 6, further comprising:

a face piece attached to the sleeve adjacent said one of the open ends.

8. The apparatus of claim 5, wherein the expandable filtering device defines a recess when the filtering device is expanded.

9. The apparatus of claim 5, wherein the filtering device comprises a material that traps aerosolized droplets.

10. The apparatus of claim 1, wherein:

the collapsible outer sleeve is constructed of flexible plastic.

11. The apparatus of claim 5, wherein:

the expandable sleeve is an expandable plastic sleeve.

12. A device that filters pathogens from cough or sneeze emissions, comprising:

a collapsible tubular outer shell including;

a first panel having first oppositely disposed straight side edges;

a second panel having second oppositely disposed straight side edges; and each of the first oppositely disposed straight side edges on the first panel being connected to one of the second oppositely disposed straight side edges on the second panel, and the panels being unconnected other than at the straight side edges, so that upon squeezing the oppositely disposed straight side edges toward each other the sleeve opens from a flattened collapsed position into a tubular shape having a passage therethrough with two open ends; and a filtering component defining a recess for receiving the cough emissions, the filtering component being attached to the outer shell so that the recess extends into the passage.

13. The device of claim 12, further comprising:

the filtering component defining an open filter end and a closed filter end, the open filter end being attached to one of the open ends of the passage and the closed filter end being within the passage.

14. The device of claim 13 wherein a cross-sectional area of the recess decreases from the open filter end to the closed filter end.

15. The device of claim 12, wherein the outer shell comprises an impermeable material impermeable to both airflow and aerosolized droplets.

16. The device of claim 12, wherein the filtering component comprises a material that traps aerosolized droplets.

17. The device of claim 12, wherein the outer shell is collapsible to collapse the passage.

18. The device of claim 12, wherein each panel comprises a flexible material.

19. The apparatus of claim 12, wherein:

the outer shell is constructed of flexible plastic.

20. The apparatus of claim 12, wherein:

the oppositely disposed straight side edges of the first panel are parallel to each other.

* * * * *